US007731120B1

(12) United States Patent
Robshaw

(10) Patent No.: US 7,731,120 B1
(45) Date of Patent: Jun. 8, 2010

(54) MANDREL FOR WOUND MATERIALS

(76) Inventor: John L. Robshaw, 112 Telmore Rd., Warwick, RI (US) 02818

( * ) Notice: Subject to any disclaimer, the term of this patent is extended or adjusted under 35 U.S.C. 154(b) by 268 days.

(21) Appl. No.: 12/006,221

(22) Filed: Jan. 2, 2008

(51) Int. Cl.
*B65H 75/18* (2006.01)

(52) U.S. Cl. ..... 242/610.2

(58) Field of Classification Search ..... 242/588, 242/588.3, 588.4, 604, 610, 610.1, 610.2, 242/118.1, 222; 206/395, 396, 397, 389
See application file for complete search history.

(56) References Cited

U.S. PATENT DOCUMENTS 2,660,298 A * 11/1953 Field ..... 242/222
3,062,368 A * 11/1962 Dunn ..... 242/610.2
3,268,069 A * 8/1966 Clark, Jr. ..... 242/610.1
3,343,665 A * 9/1967 Marino ..... 242/610.2
3,780,855 A * 12/1973 McLeod et al. ..... 242/610.2
3,908,932 A * 9/1975 Popham ..... 242/222
3,958,778 A * 5/1976 Lawson et al. ..... 242/222
4,126,285 A * 11/1978 Spruill ..... 242/222
5,205,412 A * 4/1993 Krieg ..... 206/397

* cited by examiner

*Primary Examiner*—William A Rivera
(74) *Attorney, Agent, or Firm*—Robert J Doherty

(57) ABSTRACT

A mandrel and the blank from which the mandrel is formed is constructed so as to enable shipment in flat form to a manufacturer of material, e.g., fabric, who, in turn, assembles the mandrel and uses such to wind material thereon to form a fabric bolt. The blank is easily and entirely set up by simple folding procedures.

14 Claims, 11 Drawing Sheets

MANDREL FOR WOUND MATERIALS

BACKGROUND OF THE INVENTION

This invention deals with a mandrel or support on which lengths of web-like or strand material such as fabric or dry goods are wound around. The two combined elements, i.e., mandrel and material, form what are commonly referred to as "bolts" which are then shipped to the ultimate end user, e.g., fabric store, discount outlet, wholesale distributor, decorator's or designer's workroom, upholsterer's shop, clothing manufacturer, and the like and or resellers of such material. Usually, the web material is woven cloth, fabric, upholstery material and the like; however, the term "web-like" and "strand-like" to or material is used in a broad sense to include any type of merchandise that can be wound or wrapped around and supported on a mandrel for handling, transshipping and the like. These bolts are usually formed at the supplier's facility, that is, the maker, manufacturer, textile mill, printer, distributor or other processor of the material upon preformed mandrels supplied to them by off-site manufacturers of paper and cardboard products. Generally, the mandrel fabricators are suppliers of other corrugated paperboard products such as boxes, i.e., box makers. Such mandrels are normally formed of paper and cardboard stock materials. Two mandrel forms currently in use include a multi-layer wound paper semi-elliptical hollow body with cardboard end caps glued over the opposed ends thereof and a cardboard flat box-like hollow structure with end closures glued in place.

Such prior art mandrels and the manner of their use necessitates secondary set up operations such as gluing to be performed at the mandrel manufacturer's site and then the completed mandrels shipped to the material supplier in their final ready to use set up and assembled form. Shipping the mandrels in ready to use form creates increased shipping volume per unit resulting in fewer mandrels being able to be shipped in a given volume capacity of a truck or railcar. In some cases, the use of glue in assembling the mandrels also presents an added fire hazard. In addition, a permanently assembled mandrel reduces the ease in which such mandrels can be recycled or otherwise disposed when the mandrel has served its intended purpose.

It, accordingly, would be desirable to provide a mandrel and use system for such that would obviate the above noted prior art deficiencies. These and other advantages over the prior art mandrels and their present manner of use are accomplished by the present invention which provides a mandrel blank from a flat foldable material that is shipped to the material manufacturer in such flat form. The user who then assembles the blank into the usable set up mandrel form without glue by simple and uncomplicated folding procedures. This set up procedure can easily and quickly be accomplished by the manufacturer's employees that wind or wrap the web material upon the mandrel. After the mandrel has served its purpose in the transport and material use by the ultimate end user, e.g., fabric store, discount outlet, wholesale distributor, decorator's or designer's workroom, upholsterer's shop, clothing manufacturer, and the like, the mandrel can then be simply discarded or reformed back to its flat blank form for ease in recycling or shipping back to the web supplier if volumes justify such return shipment.

These advantages are brought about by the aforementioned combination of a flat blank that can be setup and locked in a usable mandrel form without tools and from the suggested use system of such mandrel and blank. Further secondary advantages are accomplished by the particular form and structure of the blank and mandrel of the present invention that enables the easy assembly thereof and provides a resultant low cost mandrel device that can be constructed from well known cut and forming techniques at the mandrel maker's facility.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
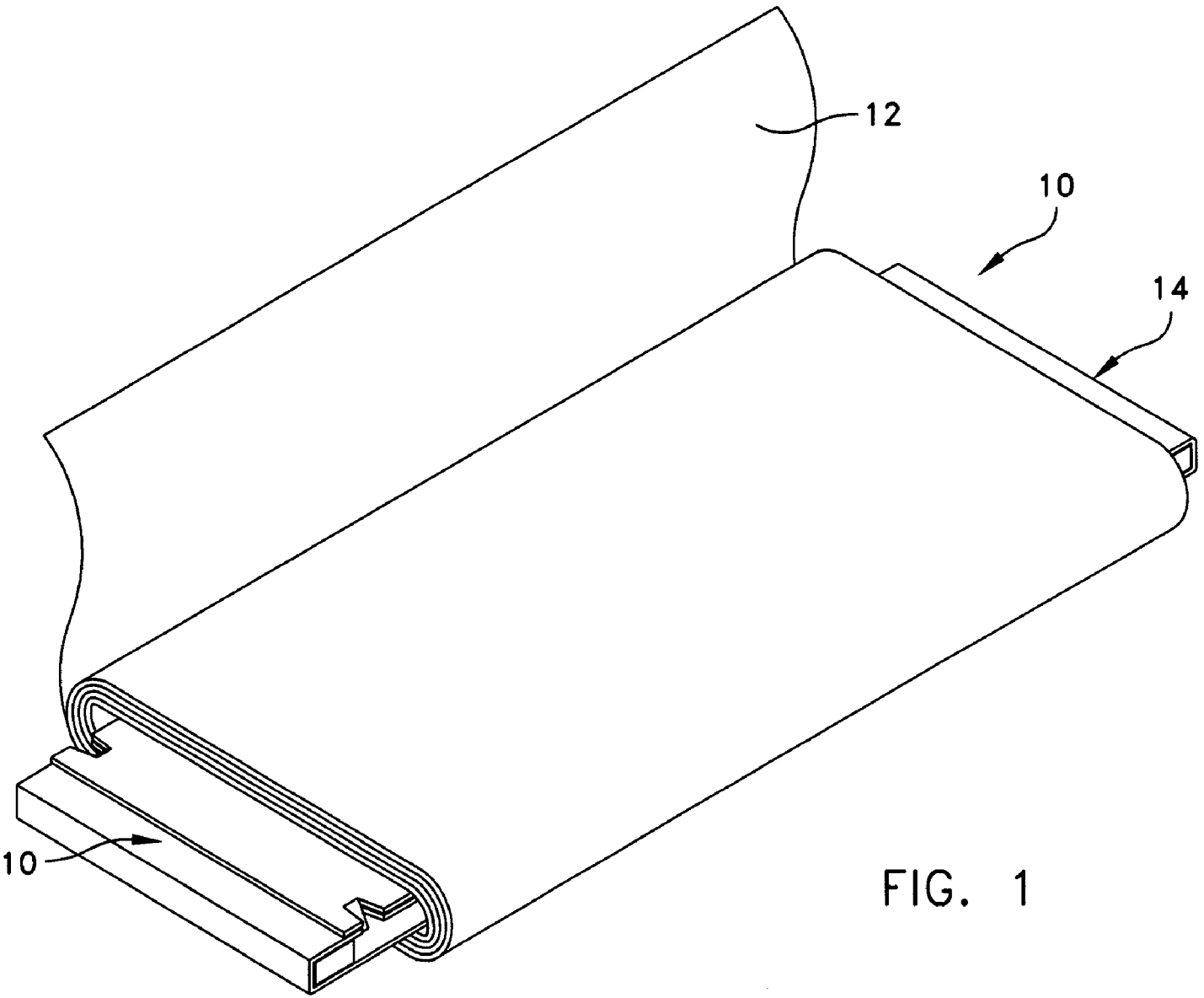
FIG. 1 is a top perspective view of a bolt of web material wound upon an assembled mandrel of the present invention to form a complete bolt thereof.
Figure 2:
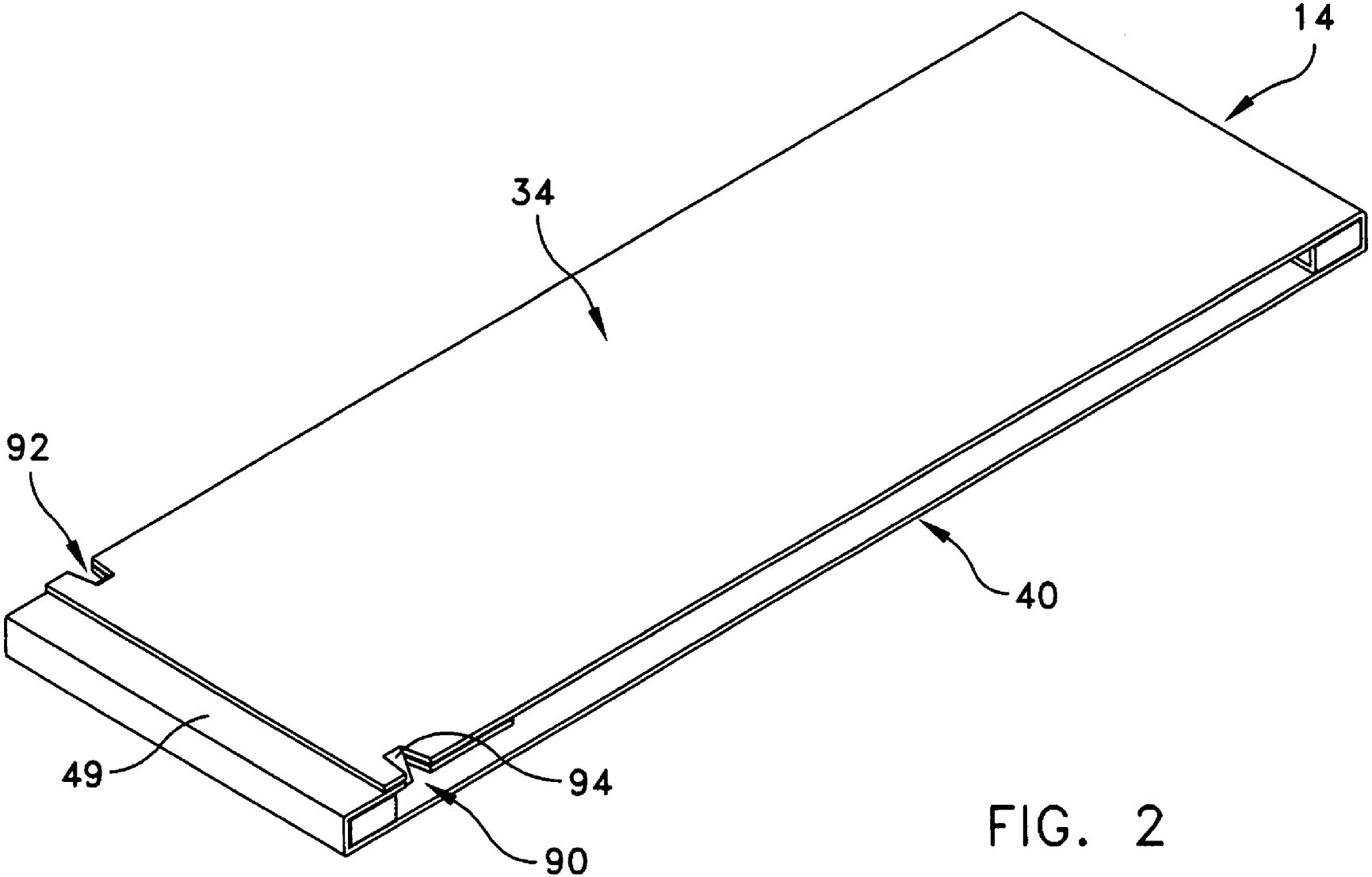
FIG. 2 is a top perspective view of the assembled mandrel of the present invention.
Figure 3:
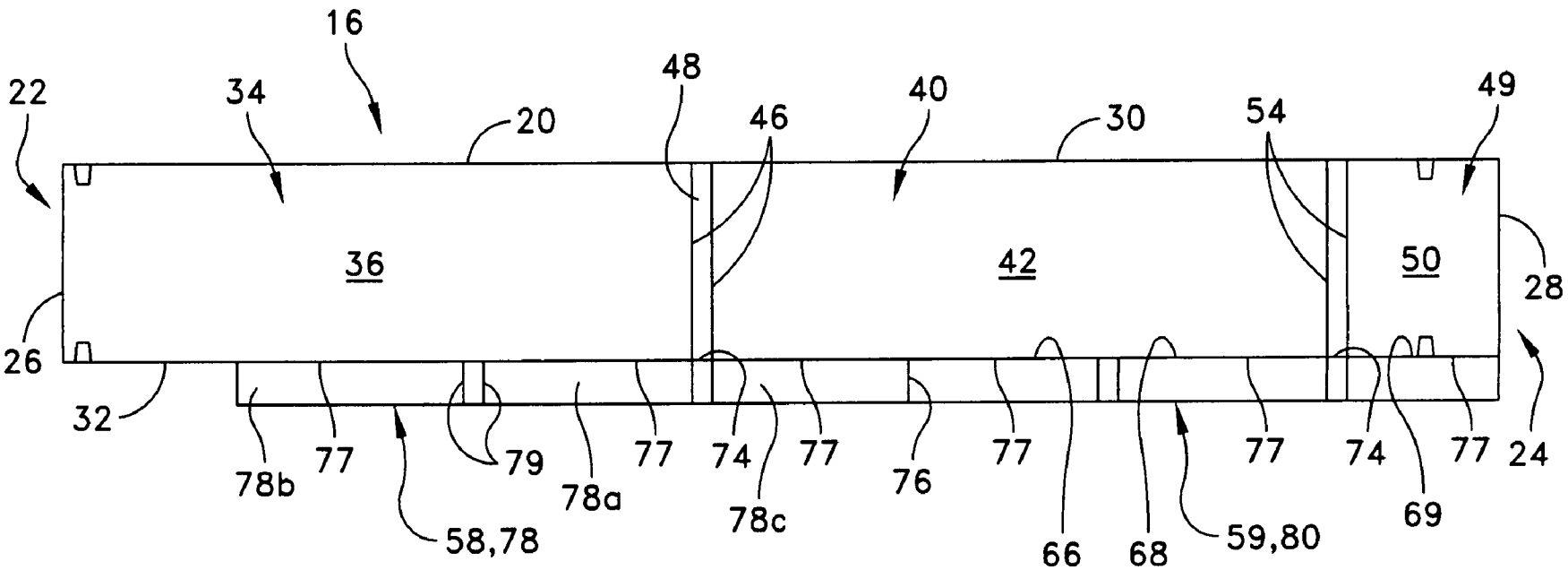
FIG. 3 is a top plan view showing the flat blank from which the mandrel is assembled.

Turning to the drawings and particularly FIGS. 1-3 thereof, a bolt 10 of web-like material 12 is shown as wound upon a supporting mandrel 14 of the present invention. The web-like material generally comprises cloth or other relatively expensive materials that are shipped from the supplier thereof to users thereof and these mandrel supported bolts facilitate the process by protecting the cloth, etc. during shipping and enable the material to be better handled by the users both for storage and facilitating unwinding desired lengths thereof.

The mandrel 14 shown in an assembled or set up form in FIGS. 1 and 2 is formed from a blank 16 depicted in FIG. 3. Such blank 16 is flat and generally formed from corrugated cardboard material by standard forming processes including cutting, perforating and crushing such material. Although corrugated cardboard is the most commonly chosen material for the instant use due to availability and cost, other materials such as cardboard, heavy paper stock, plastic resinous sheet and foam with or without paper coverings and other related materials can be utilized provided the mandrels once processed into blanks can be folded, broken apart and support hinged elements that are bent into placed as required by the instant invention.

The blank 16 is of flat elongated overall configuration and includes a main panel 20 having upper 22 and lower 24 opposed ends terminating in upper and lower edges 26, 28 respectively as well as laterally spaced side edges 30 and 32. The main panel 20 further includes a top panel 34 having top and bottom surfaces 36, 38 respectively. The top panel is, in turn, attached to a bottom panel 40 adjacent thereto via a pair of laterally disposed bend lines 46 which, in turn, form an upper spacing panel 48 as will hereinafter be apparent. The bottom panel includes top and bottom surfaces 42, 44 respectively.

Figure 6:
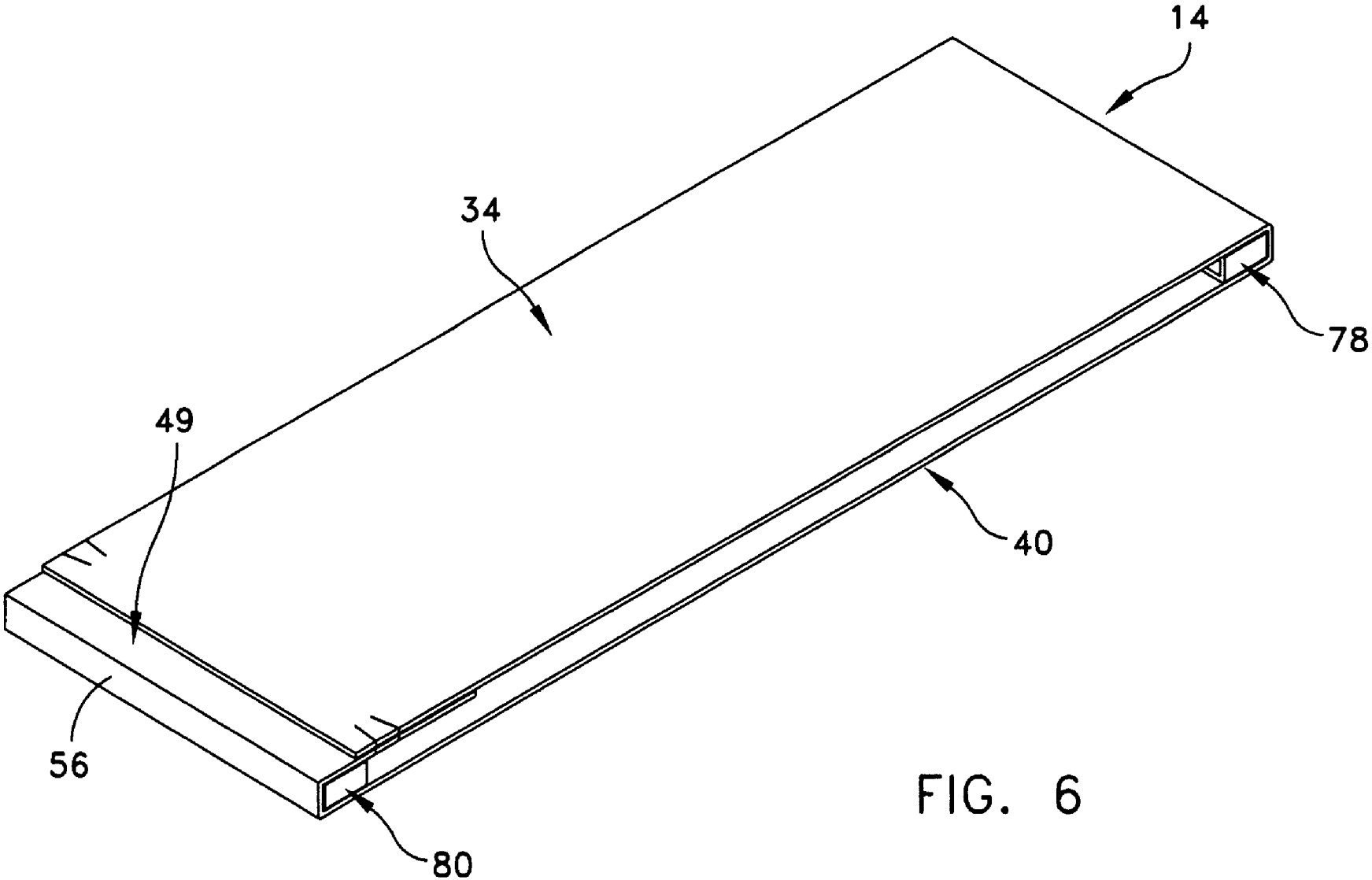
FIG. 6 is a top perspective view similar to FIG. 5 but showing the further folding of the top panel over but spaced from the bottom panel and over and in contact with portions of the outer surface of the support pane.
Figure 7:
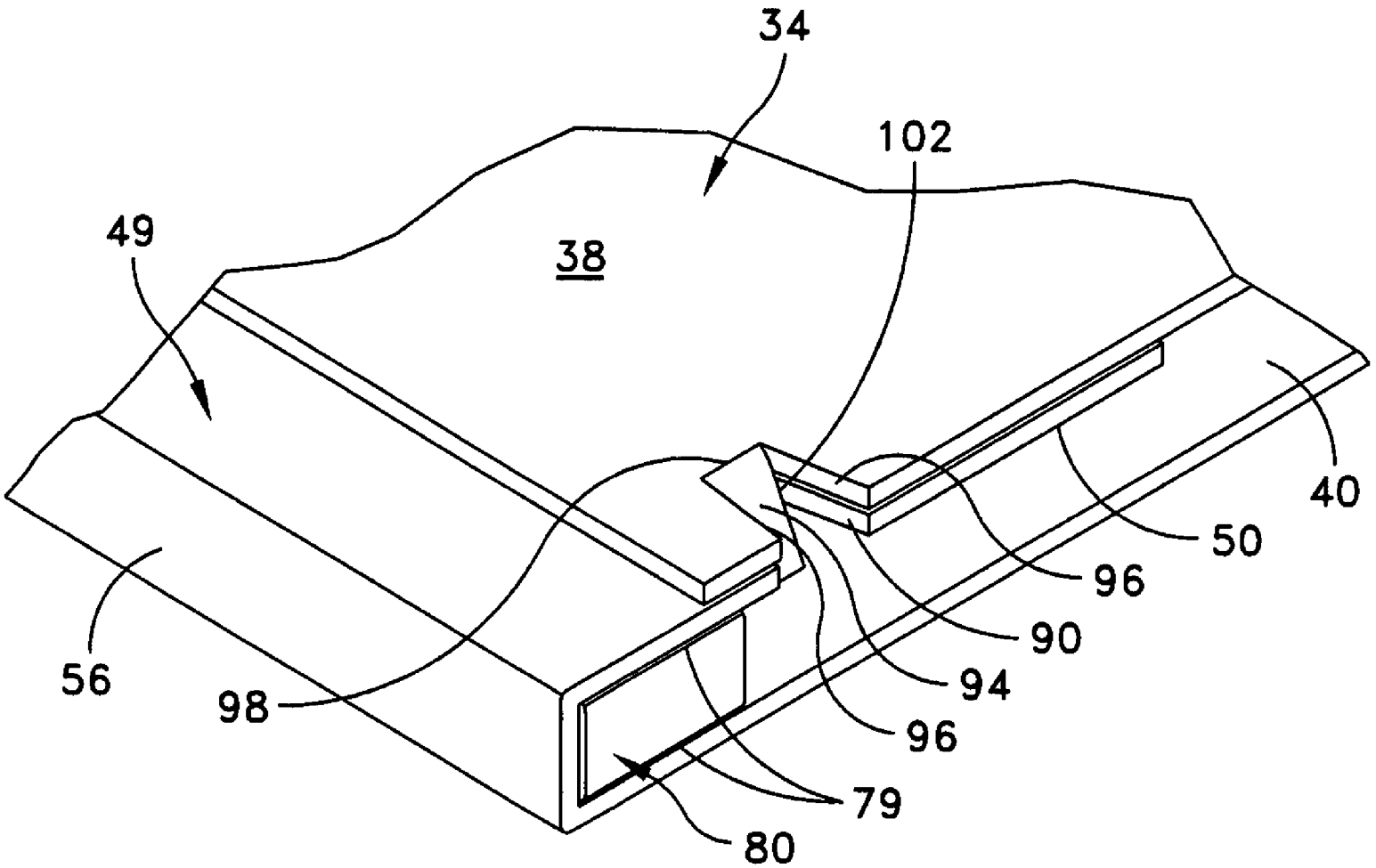
FIG. 7 is a partial perspective view showing the locking means.
Figure 8:
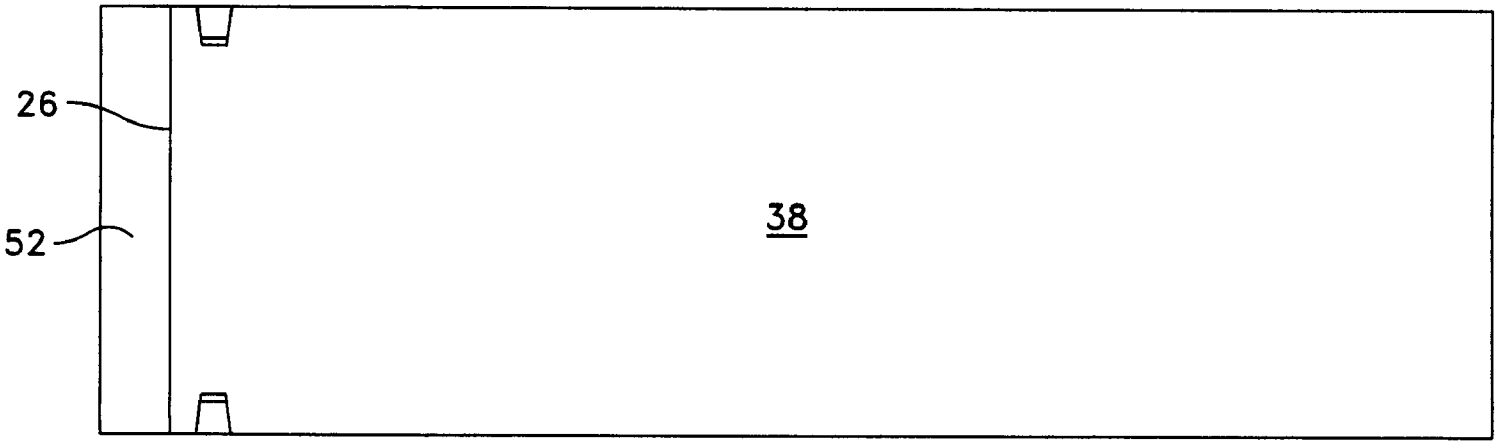
FIG. 8 is a top plan view of the assembled mandrel.
Figure 9:
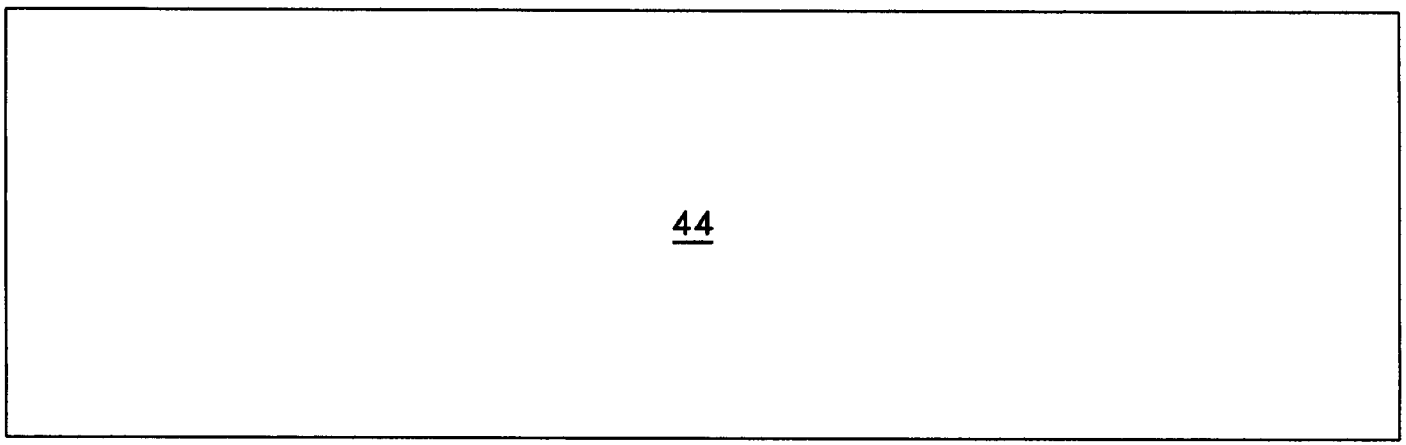
FIG. 9 is a bottom plan view of the assembled mandrel.
Figure 10:
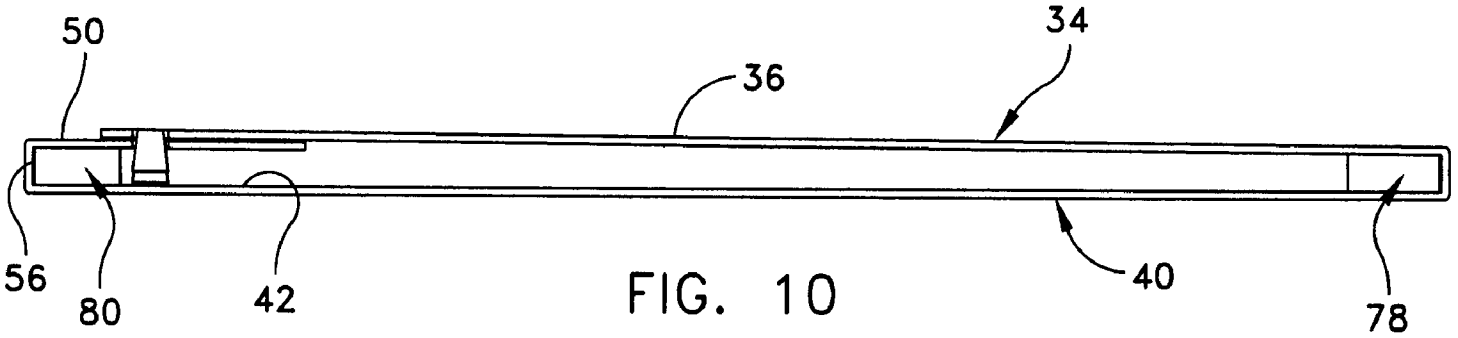
FIG. 10 is a front elevational view of the assembled mandrel.
Figure 11:
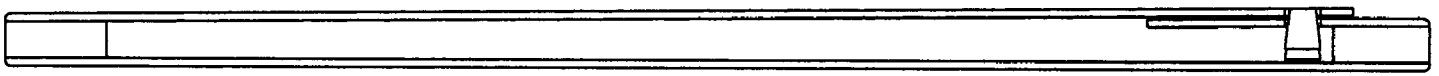
FIG. 11 is a rear elevational view of the assembled mandrel.
Figure 12:
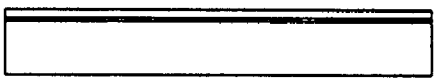
FIG. 12 is a left end elevational view of the assembled mandrel.
Figure 13:
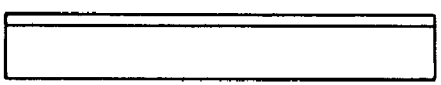
FIG. 13 is a right end elevational view of the assembled mandrel.

A support panel 49 having top and bottom surfaces 50, 52 respectively is, in turn, connected to the bottom panel via a pair of laterally extending bend lines 54 which, in turn, form a lower spacing panel 56. The bend lines 46 and 54 are parallel to each other and are preferably formed by crushing or creasing the cardboard between opposed die surfaces to create, in effect, weakened or scored lines about which the material can be easily bent—hence, the term "bend lines". In this way, the upper, lower and support panels can be bent or folded with respect to each other to set up the mandrel assemblage or set up form shown in FIGS. 2 and 6. In such position, the support panel 48 is upwardly swung around, i.e., bent, about the lower spacing panel 56, such that the top surface 50 thereof partially overlies the top surface 42 of the bottom panel 40 and is spaced therefrom partially by the lower spacing panel 56 a distance equal to the longitudinal extent of such spacing panel, that is, the longitudinal distance between the bend lines 54. The spacing panel 49 assumes a vertical or upright position when the support panel 49 is positioned as depicted in FIGS. 2 and 6.

One edge 32 of the main panel 20 is provided with longitudinally extending first and second flaps 58, 59 releasably connected thereto along weakened lines 60, 62, and 64 and 66, 68 and 69 respectively and permanently attached to the edge 32 by hinge connections 70 and 72 that coincide with the bend lines 46 and 54 and, in effect, form continuations thereof. In addition, a weakened line 76 enables the separation of the two flaps extending laterally from the one edge 32. Each flap is provided with a bend line or crease 74 that enables each flap to be turned or bent upwardly about such bend line 74. While the lines 60, 62, 64, 66, 68 and 69 have been described as formed as by perforating or partially cutting the original main panel so the flaps can be separated therefrom except for the hinged connections therewith, such weakened lines could take the form of completely severed lines or include a minimal, e.g., one or two, contact connection points to enable such separation by those assembling the mandrel from the original blank form. Naturally, the above-described connections or lack thereof should not create a nuisance to those handling the mandrel blanks in their flat form for shipping to users or movement about a manufacturing or handling facility, i.e., one does not want the flaps to be "flapping about".

Figure 4A:
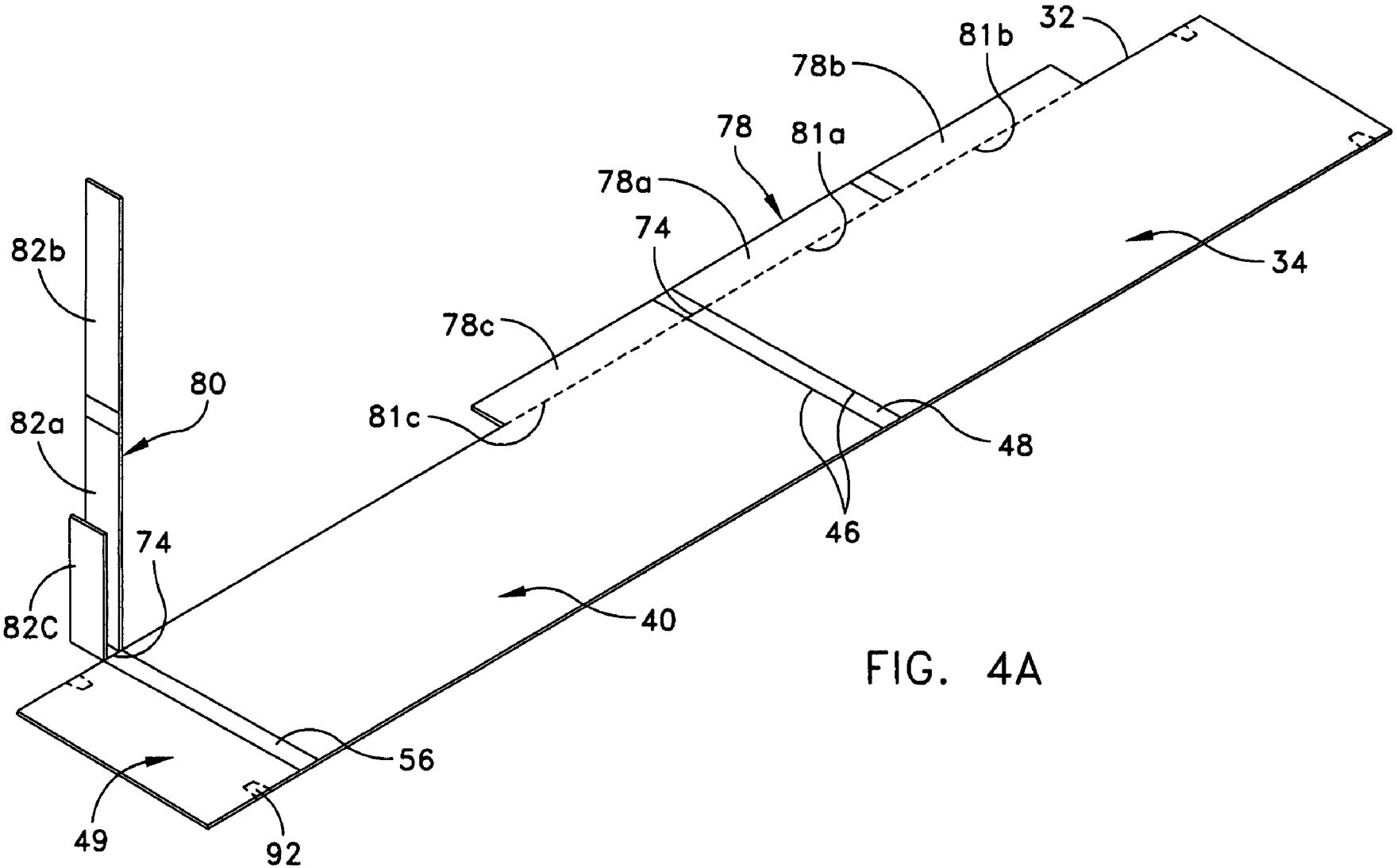
FIG. 4*a* is a partial perspective view showing the manner in which the flaps are partially detached from the main panel edge and folded to form the stiffening panels or supports shown in FIGS. 4 and 5.
Figure 4B:
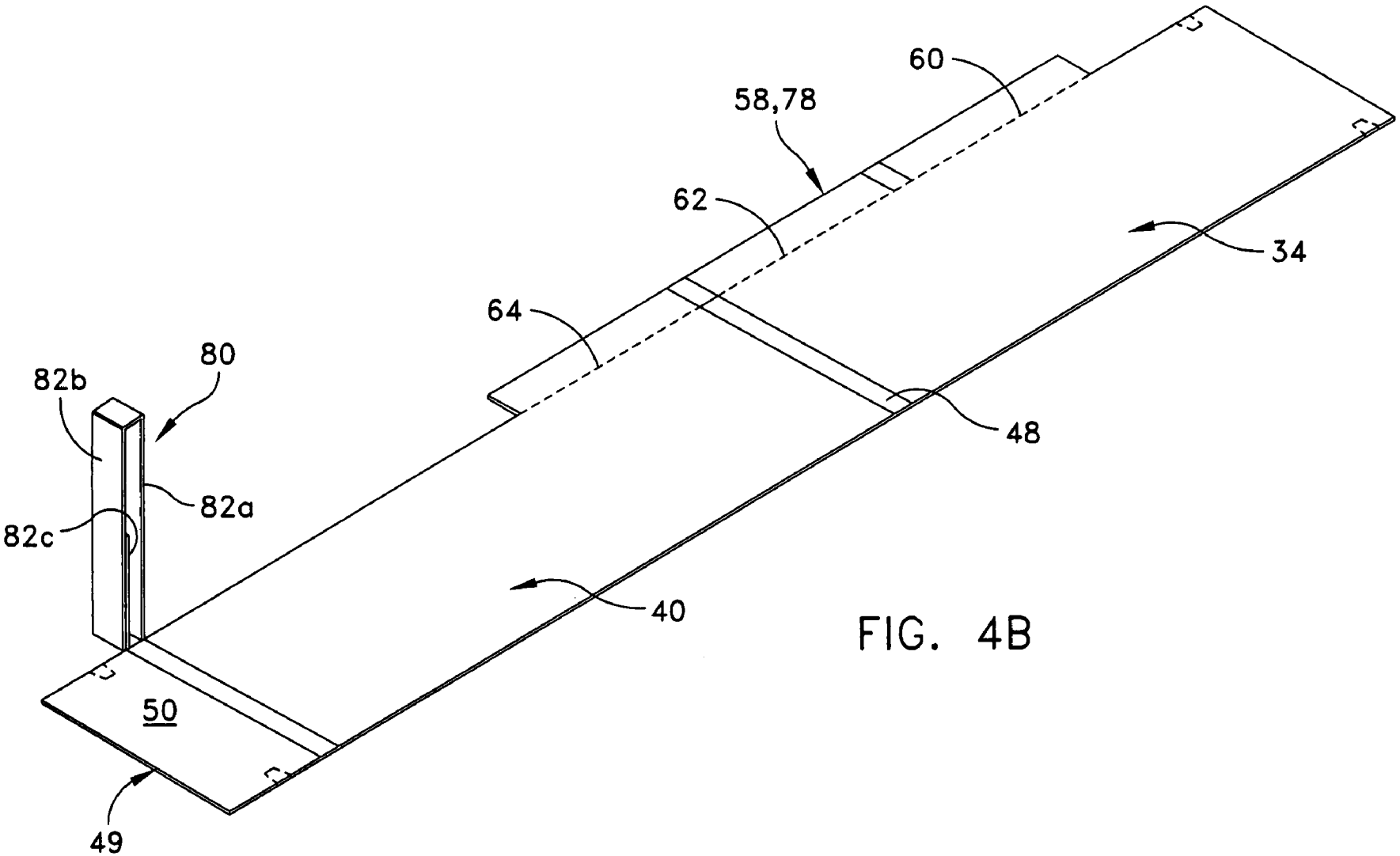
FIG. 4*b* is a partial perspective view similar to FIG. 4*a* showing a further progression of the flap folding procedure.
Figure 4:
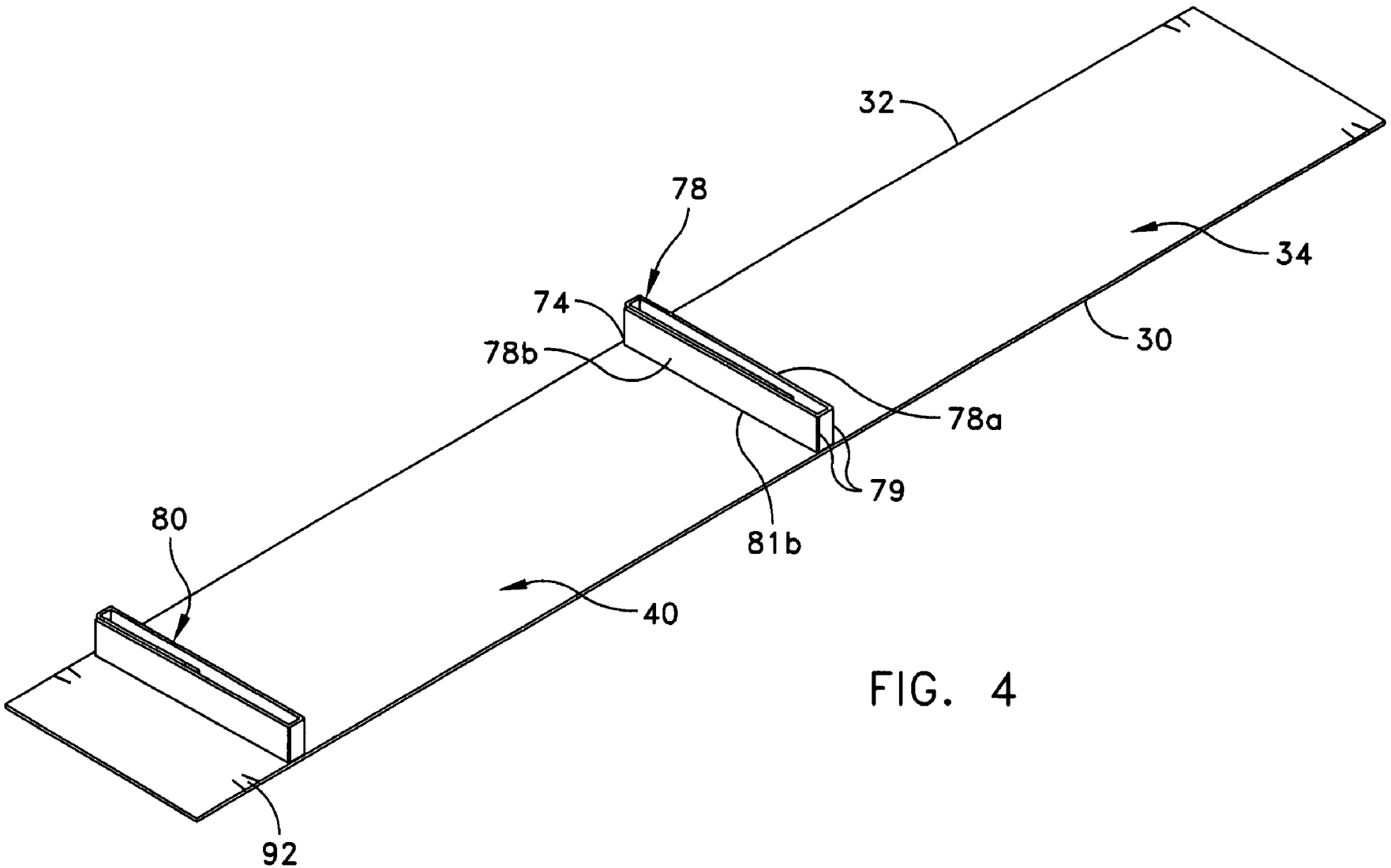
FIG. 4 is a top perspective view of the blank shown in FIG. 3 showing the lower and upper stiffening panels or supports positioned upon the inner surface of the bottom panel.
Figure 5:
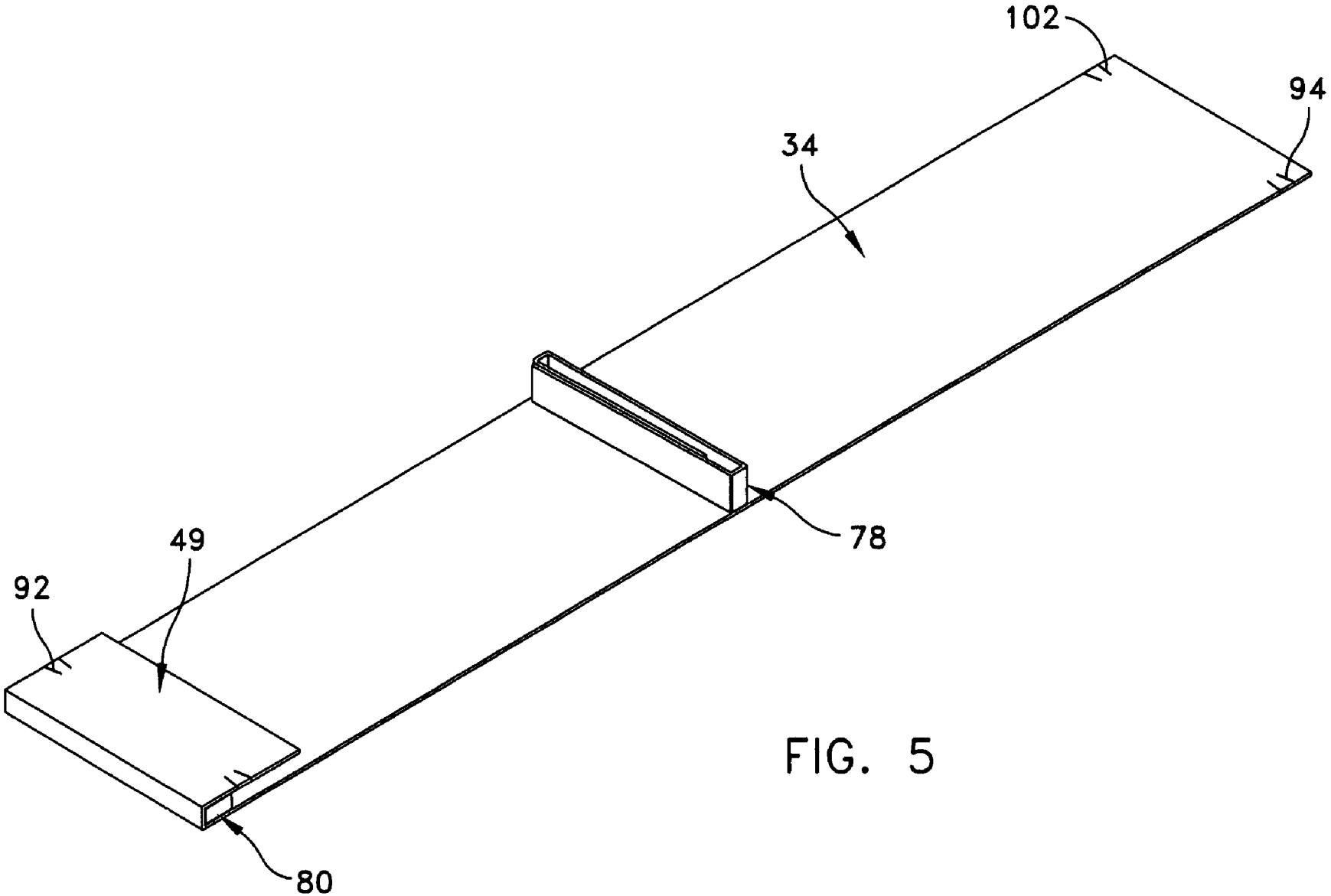
FIG. 5 is a top perspective view similar to FIG. 4 but showing the support panel folded over a portion of the bottom panel.

By referring to FIGS. 3-6, it will be apparent that the further upward folding or bending of the top panel 34 about the upper spacing panel 48 formed by the bend lines 46 takes place such that the top surface 36 of the top panel 34 overlies the bottom panel and additionally extends over and contacts the bottom surface 52 of the support panel 49. In order to better separate the panels from each other and so as to not totally depend upon the spacing panels 48 and 54 for such purpose, the two separate flaps 58 and 59 are adapted by longitudinal bending of portions thereof and the subsequent upward inward bending along their separate hinge lines 74 to form upper and lower stiffening panels 78 and 80 respectively. The flaps are attached to the main panel edge 32 by either a weakened edge that can be broken away or one or more slight material attachment points 77 that can be broken to free each flap for the folding procedure hereinafter described. As shown in the progression of forming sequences best depicted in FIGS. 4*a* and 4*b*, it should be clear that each flap has at least one foldable finger or finger portion and preferably two or even three foldable fingers as shown in the drawings. Referring to the upper stiffening panel 78, such may include a first finger 78*a* connected to a second finger 78*b* via a pair of bend lines 79 and a third finger 78*c* disposed on the other side of the hinge connection 74. The three fingers are adapted to be folded about each other as depicted in the drawings preferably with the third finger disposed between the first and second fingers and subsequently formed upper stiffening panel 78 disposed along the bend lines 46 with the edges 81*a*, 81*b* and 81*c* of the fingers 78*a*, 78*b*, and 78*c* that were previously disposed along the one edge 32 are in contact with the upper surface of the upper spacing panel 48. A similar disposition of the fingers 82*a*, 82*b* and 82*c* of the lower flaps forms the lower stiffening panel 80 wherein the finger edges previously disposed along edge 32 contact the lower spacing panel 56. These stiffening panels 78, 80 serve to add rigidity to the mandrel structure and serve to provide platform surfaces against which the bent support and top panels rest. The flaps 58, 59 are preferably separated from each other by a cut line 76.

The terminal edge 26 of the top panel 34 is preferably adapted by the relative length of such panel to overlie the support panel and at least to some extent overlie the lower stiffening panel 80 so that the end of the top panel is prevented from downward movement. Alternatively, the support panel could overlap that end 22 of the top panel but the form shown in the drawings is preferred. Locking means 90 for holding the top and support panels together is provided preferably in the form of a pair of notches 92 inwardly directed from the longitudinal edges of the support panel 48 and positioned adjacent the inwardly disposed extent of the lower stiffening panel 80. A pair of bendable tabs 94 are provided that inwardly extend from the longitudinal edges of the top panel 34. The tabs 94 are formed along weakened lines 96 and include a hinge line 98 about which they may be downwardly bent into the notches 92. The notches 92 and tabs 94 are aligned with respect to each other. Preferably, two notch/tab combinations are provided, but one notch/tab combination could suffice. Also, the notch may also be formed by a secondary tab 96 which is downwardly bent to form an open notch construction before the tab 94 is bent thereinto or alternatively both tabs 94 and 96 are bent downwardly simultaneously in the above-described alternate form. In either form, the tab 94 contacts the detached edge portions 100 of the support panel from which the tab is formed and to some extent the top surface 50 upper surface of the support panel which has been folded over to face the top surface of the bottom panel 40. The tab(s) 94 are preferably outwardly flared such that the wider extent thereof is disposed lowermost in the locked position and will thus better resist any upward urging motion of the top panel to swing upwardly to an unbent position and for the tabs to pull out of the notches by frictional engagement between the tab edges 102 and the notch edges 100 in a wedging action. This outward flare also enables contact of the tab edges 102 with the edges of the upper stiffening panel 48 when the positioning characteristics of the notches enables such.

Other alternative locking means can be utilized such as gluing the top and support panels together or by placing a separable connector such as a plastic dart therebetween but such procedures involve secondary steps and could interfere with one of the main objectives of the present invention—that of enabling the assembled mandrel to be knocked down by simple hand manipulation to a flat and easy to handle form for reuse as a mandrel or recycled as cardboard scrap.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A foldable blank for forming a mandrel for supporting wound material thereon, said blank comprising a flat longitudinally oriented main panel having upper and lower opposed ends terminating in upper and lower edges respectively, said main panel further including opposed longitudinally oriented laterally spaced side edges, said main panel in turn including a top panel, a bottom panel and a support panel wherein the top panel is connected to the bottom panel by a pair of laterally spaced parallel adjacent bend lines forming an upper spacing panel and said bottom panel is connected to said support panel by a pair of laterally spaced parallel adjacent bend lines forming a lower spacing panel, a lower laterally oriented stiffening support in the form of a longitudinally oriented first flap hingedly connected to a side of said main panel proximal the lower end thereof and an upper laterally oriented stiffening support in the form of a longitudinally oriented second flap hingedly connected to a side of said main panel proximal the upper end thereof, said first and second flaps including at least a first pair of laterally oriented spaced fold lines forming upright stiffening panels for positioning between said top and bottom panels when said top and said support panel are bent about said bottom panel and said flaps are positioned therebetween wherein said stiffening panels are each hingedly connected to one edge of each of said spacing panels for positioning adjacent said upper and bottom spacing panels.

2. The blank of claim 1, said flap extension comprising upper and lower finger segments longitudinally extending from opposed sides of said spacing panel and in turn at least one of said flap segments having a pair of longitudinally spaced laterally directed fold lines in part forming said stiffening panel.

3. A foldable blank for forming a mandrel for supporting wound material thereon, said blank comprising a flat longitudinally oriented main panel having upper and lower opposed ends terminating in upper and lower edges respectively, said main panel further including opposed longitudinally oriented laterally spaced side edges, said main panel in turn including a top panel, a bottom panel and a support panel wherein the top panel is connected to the bottom panel by a pair of laterally spaced parallel adjacent bend lines forming an upper spacing panel and said bottom panel is connected to said support panel by a pair of laterally spaced parallel adjacent bend lines forming a lower spacing panel, a lower laterally oriented stiffening support in the form of a longitudinally oriented first flap hingedly connected to a side of said main panel proximal the lower end thereof and an upper laterally oriented stiffening support in the form of a longitudinally oriented second flap hingedly connected to a side of said main panel proximal the upper end thereof, said first and second flaps including at least a first pair of laterally oriented spaced fold lines forming upright stiffening panels for positioning between said top and bottom panels when said top and said support panel are bent about said bottom panel and said flaps are positioned therebetween including locking means to connect said top panel to said support panel.

4. The blank of claim 3, said locking means comprising a bendable tab defined by weakened lines on at least one longitudinal edge of said top panel, said tab adapted to extend into an opening notch provided in said support panel.

5. A mandrel for winding web material thereon comprising a flat foldable sheet-like longitudinally oriented main panel in turn having a top panel, a bottom panel and a support panel each connected to each other by pairs of laterally disposed and spaced adjacent parallel bend lines in turn forming upper and lower spacing panels respectively when said support panel is folded over said bottom panel and said top panel is folded over said bottom panel and at least portions of said support panel, a lower stiffening panel hingedly connected to one side of said lower spacing panel and an upper stiffening panel hingedly connected to one side of said upper spacing panel, both said stiffening panels comprising flaps that include longitudinally folded flap portions laterally disposed between said top and bottom panels so as to maintain the spacing between said upper and lower panels.

6. The mandrel of claim 5, said stiffening panels disposed adjacent said upper and lower spacing panels respectively.

7. The mandrel of claim 5, said flaps being narrow strips formed from said main panel, said flaps including first and second pairs of laterally oriented placed folding lines forming first and second upright spacer panels laterally disposed between said top and bottom panels.

8. The mandrel of claim 7, said upright spacer panels disposed adjacent the opposite edge walls of said top, bottom and support panels.

9. The mandrel of claim 5, including locking means for releasably connecting said top panel to said support panel.

10. The mandrel of claim 9, said locking means including a bendable tab on at least one longitudinally edge of said top panel and an opening notch provided on an edge of said support panel, said tab overlying said notch and adapted to be folded thereinto.

11. The mandrel of claim 10, said support panel notch spaced from said lower spacing panel by at least the width of said upper stiffening panel.

12. The mandrel of claim 11, said panel notch positioned adjacent said lower spacing panel so that said tab contacts said lower stiffening support so as to assist in holding such stiffening support against the lower spacing panel.

13. The mandrel of claim 5, wherein the recited component parts thereof are formed of a corrugated cardboard material.

14. The mandrel of claim 5, wherein portions of said flaps are releasably attached to said main panel along a perforated weakened line.

* * * * *